US009395128B2

(12) United States Patent
Treadway et al.

(10) Patent No.: US 9,395,128 B2
(45) Date of Patent: Jul. 19, 2016

(54) PROJECTILE LAUNCHING DEVICES AND METHODS AND APPARATUS USING SAME

(71) Applicant: Corvid Technologies, Inc., Mooresville, NC (US)

(72) Inventors: Sean K. Treadway, Mooresville, NC (US); Andrew N. Lloyd, Mooresville, NC (US)

(73) Assignee: Corvid Technologies, Inc., Mooresville, NC (US)

( * ) Notice: Subject to any disclaimer, the term of this patent is extended or adjusted under 35 U.S.C. 154(b) by 362 days.

(21) Appl. No.: 13/853,313

(22) Filed: Mar. 29, 2013

(65) Prior Publication Data

US 2014/0338554 A1 Nov. 20, 2014

Related U.S. Application Data

(60) Provisional application No. 61/770,076, filed on Feb. 27, 2013, provisional application No. 61/694,681, filed on Aug. 29, 2012.

(51) Int. Cl.

| | |
|---|---|
| ***F41A 1/00*** | (2006.01) |
| ***F42D 5/04*** | (2006.01) |
| ***F41F 7/00*** | (2006.01) |
| ***F42B 3/22*** | (2006.01) |

(52) U.S. Cl.

CPC ... *F41A 1/00* (2013.01); *F41F 7/00* (2013.01); *F42B 3/22* (2013.01); *F42D 5/04* (2013.01)

(58) Field of Classification Search

CPC ..... F42B 1/024; F42B 3/22; F42D 5/04; F42D 5/045; F41A 1/00; F41F 1/00; F41F 7/00

USPC ..... 102/200, 202, 204, 205, 379, 381; 86/50

See application file for complete search history.

(56) References Cited

U.S. PATENT DOCUMENTS 3,249,046 A * 5/1966 Balchan ..... F41A 1/00 181/142
3,434,197 A * 3/1969 Davenport ..... B23K 20/085 228/107

(Continued)

OTHER PUBLICATIONS

Kerrisk et al. "Problems Associated with Launching Hypervelocity Projectiles from the Fast Shock Tube," The 1992 Hypervelocity Impact Symposium, Nov. 17-20, 1992 (24 pages).

(Continued)

*Primary Examiner* — James S Bergin
(74) *Attorney, Agent, or Firm* — Myers Bigel & Sibley, P.A.

(57) ABSTRACT

A projectile launching device includes a reactive driver, a flyer housing, a flyer and a compressible buffer member. When detonated, the reactive driver will generate a detonation shock wave. The flyer housing defines a bore. The flyer is disposed in the bore and has a rear surface. The buffer member is interposed between the reactive driver and the flyer. The buffer member has a front surface in direct contact with the rear surface of the flyer. The buffer member is configured and arranged to: receive the detonation shock wave from the reactive driver; modify the detonation shock wave to generate a modified shock wave; and transmit the modified shock wave directly to the flyer to thereby propel the flyer away from the buffer member.

18 Claims, 15 Drawing Sheets

(56) References Cited

U.S. PATENT DOCUMENTS

| | | | | | |
|---|---|---|---|---|---|
| 4,062,112 | A * | 12/1977 | Lake | B23D 15/145 30/228 |
| 4,665,826 | A * | 5/1987 | Marer | F42B 1/024 102/401 |
| 8,904,936 | B2 * | 12/2014 | Treadway | F42D 5/045 102/315 |
| 2012/0174811 | A1 | 7/2012 | Treadway et al. | |

OTHER PUBLICATIONS

Marsh et al. "Acceleration of Metal Plates," 1989 APS Topical Conference on Shock Compression of Condensed Matter, Aug. 14-17, 1989, Albuquerque, New Mexico (5 pages).

Marsh et al. "Hypervelocity Plate Acceleration," Proceedings of APS 1991 Topical Conference on Shock Compression of Condensed Matter, Jun. 17-20, 1991, Williamsburg, Virginia (8 pages).

* cited by examiner

NOTE: DIMENSIONS ARE IN INCHES

NOTE: DIMENSIONS ARE IN INCHES

PROJECTILE LAUNCHING DEVICES AND METHODS AND APPARATUS USING SAME

RELATED APPLICATION(S)

This application claims the benefit of and priority from U.S. Provisional Patent Application 61/770,076, filed Feb. 27, 2013, and U.S. Provisional Patent Application No. 61/694,681, filed Aug. 29, 2012, the disclosures of which are incorporated herein by reference.

STATEMENT OF GOVERNMENT SUPPORT

This invention was made with support under Small Business Innovation Research (SBIR) Contract No. FA8651-08-C-0167 awarded by the US Air Force. The Government has certain rights in the invention.

FIELD OF THE INVENTION

The present invention relates to launching devices and, more particularly, to launching devices for launching projectiles at high velocity or hypervelocity.

BACKGROUND OF THE INVENTION

Launchers have been designed and used to accelerate projectiles (such as plates, discs or flyers) at high velocities (from about 0.5 km/s to 2 km/s) and hypervelocities (from about 2 km/s to 9.5 km/s) using high explosives. Launchers of this type have been used in equation of state (EOS) research in order to achieve high pressure and high internal energy states, for example.

SUMMARY OF THE INVENTION

According to embodiments of the present invention, a projectile launching device includes a reactive driver, a flyer housing, a flyer and a buffer member. When detonated, the reactive driver will generate a detonation shock wave. The flyer housing defines a bore. The flyer is disposed in the bore and has a rear surface. The buffer member is interposed between the reactive driver and the flyer. The buffer member has a front surface in direct contact with the rear surface of the flyer. The buffer member is configured and arranged to: receive the detonation shock wave from the reactive driver; modify the detonation shock wave to generate a modified shock wave; and transmit the modified shock wave directly to the flyer to thereby propel the flyer away from the buffer member.

According to embodiments of the present invention, a projectile launching device includes a reactive driver, a flyer, and a buffer member. When detonated, the reactive driver will generate a detonation shock wave. The flyer has a rear surface. The buffer member is interposed between the reactive driver and the flyer. The buffer member has a front surface in direct contact with the rear surface of the flyer. The buffer member is configured and arranged to: receive the detonation shock wave from the reactive driver; modify the detonation shock wave to generate a modified shock wave; and transmit the modified shock wave directly to the flyer to thereby propel the flyer away from the buffer member. The front surface of the buffer member is substantially coextensive with the rear surface of the flyer.

According to embodiments of the present invention, a projectile launching device includes a reactive driver, a flyer, and a buffer member. When detonated, the reactive driver will generate a detonation shock wave. The buffer member is interposed between the reactive driver and the flyer. A rear section of the buffer member is axially tapered and circumferentially surrounded by the reactive driver. The buffer member is configured and arranged to: receive the detonation shock wave from the reactive driver; modify the detonation shock wave to generate a modified shock wave; and transmit the modified shock wave to the flyer to thereby propel the flyer away from the buffer member.

According to embodiments of the present invention, a projectile launching device includes a reactive driver, a disc-shaped flyer, and a buffer member. When detonated, the reactive driver will generate a detonation shock wave. The buffer member is interposed between the reactive driver and the flyer. The buffer member is configured and arranged to: receive the detonation shock wave from the reactive driver; modify the detonation shock wave to generate a modified shock wave; and transmit the modified shock wave to the flyer to thereby propel the flyer away from the buffer member. The flyer has a mass of at least about 0.05 grams. The projectile launching device is configured to propel the flyer at a velocity of at least about 0.5 kilometers/second.

According to embodiments of the present invention, a method for selectively detonating an unexploded explodable device having a casing includes providing a projectile launching device including a reactive driver and a flyer. The method further includes: placing the projectile launching device proximate the casing; and detonating the reactive driver such that the reactive driver generates a detonation shock wave that is transmitted to the flyer and propels the flyer to strike the casing. An impact of the flyer striking the casing causes the detonable device to detonate.

According to embodiments of the present invention, an explosive munition system includes a target explosive and a projectile launching device. The projectile launching device includes: a reactive driver that, when detonated, will generate a detonation shock wave; and a flyer. The projectile launching device can be actuated to detonate the reactive driver to propel the flyer to detonate the target explosive via shock-to-detonation transition.

DETAILED DESCRIPTION OF EMBODIMENTS OF THE INVENTION

Figure 1:
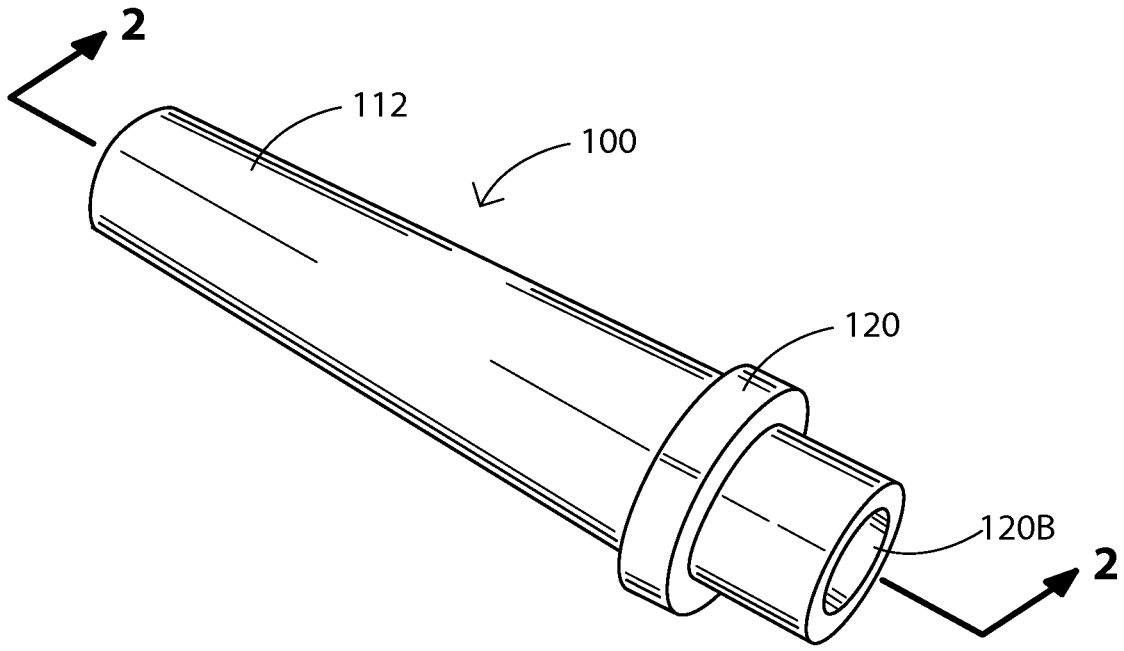
FIG. 1 is a front perspective view of a projectile launching device according to embodiments of the present invention.
Figure 2:
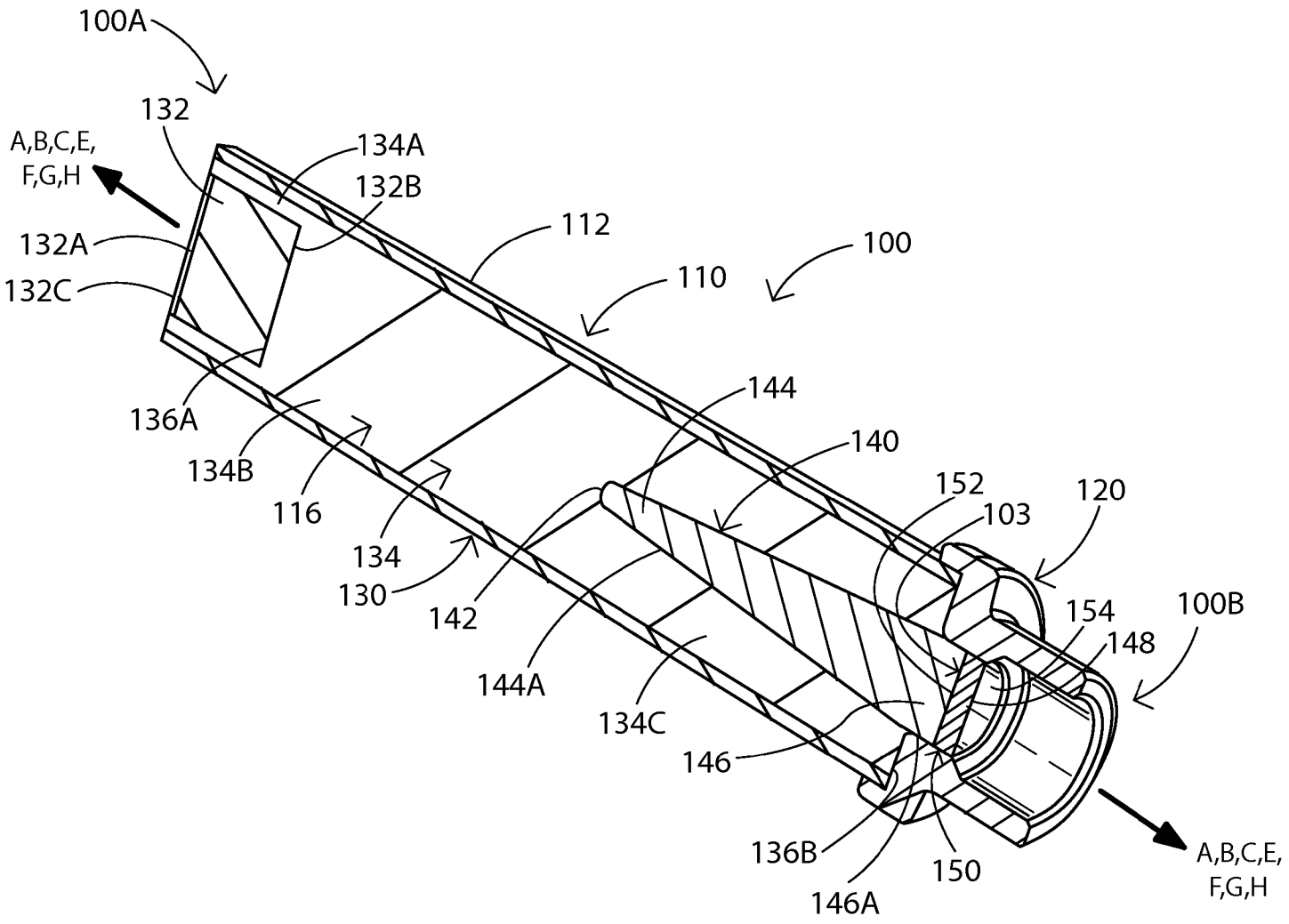
FIG. 2 is a perspective, cross-sectional view of the launching device of FIG. 1 taken along the line 2-2 of FIG. 1.
Figure 3:
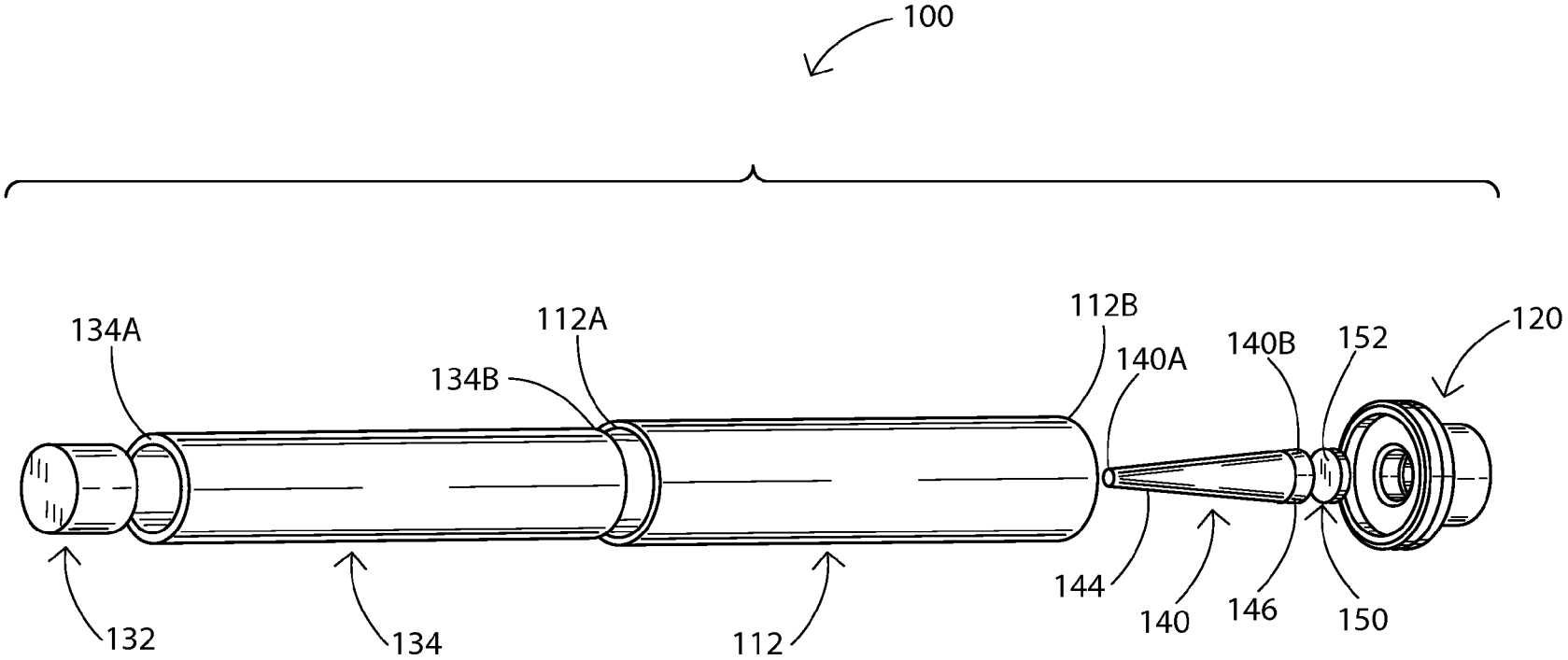
FIG. 3 is an exploded, rear perspective view of the launching device of FIG. 1.
Figure 4:
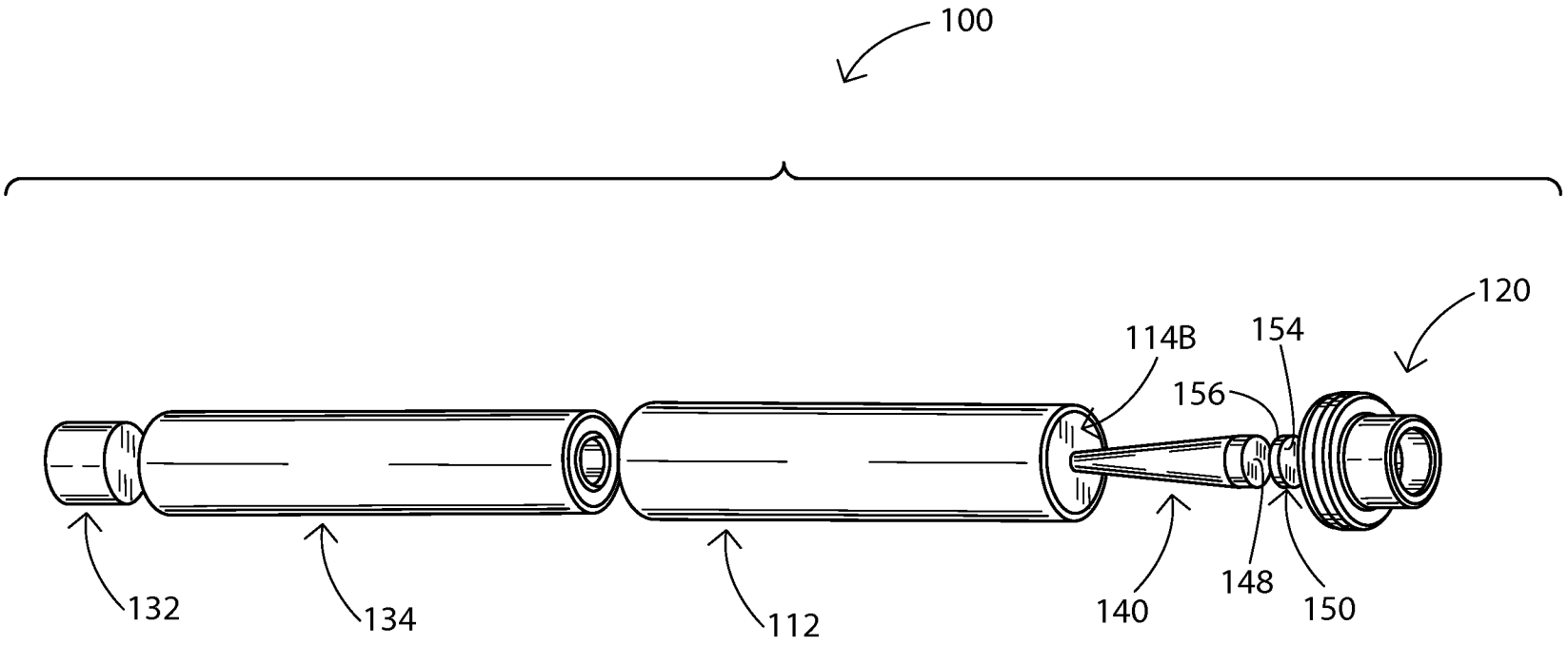
FIG. 4 is an exploded, front perspective view of the launching device of FIG. 1.
Figure 5:
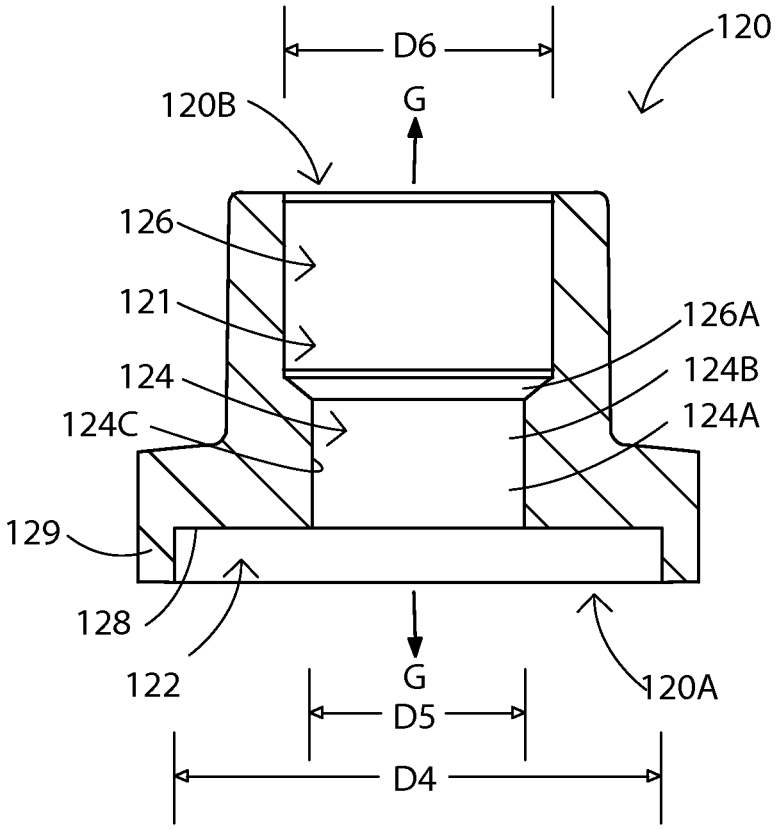
FIG. 5 is a cross-sectional view of a bezel forming a part of the launching device of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "shock wave" refers to a sudden and nearly discontinuous change in density, pressure, and temperature that advances through a material with a velocity corresponding to the maximum pressure of the shock wave.

As used herein "high velocity" means from about 500 to 2000 meters per second (m/s).

As used herein "hypervelocity" means greater than 2000 m/s.

As used herein "disc-shaped" refers to a flat, circular article having a maximum diameter that is greater than its height or thickness.

As used herein "shock impedance" means the product of a material's pre-shocked density and the velocity of shock in the material. See, e.g., Asay, J., Shahinpoor, M., eds. "High-Pressure Shock Compression of Solids," Springer-Verlag, 1993, p. 29.

Embodiments of the present invention are directed to a projectile launching device that can propel a projectile at a high velocity or hypervelocity using a detonation shockwave from a reactive driver (e.g., high explosive). The propelled projectile may remain substantially stable over the course of at least a prescribed flight distance and can produce a high pressure in or perforate a target material. The propelled projectile may have a relatively large, nearly flat frontal area capable of producing nearly planar shock waves having an area substantially larger than rounded or ogive shaped projectiles having of the same mass. A projectile launching device of the present invention may be used in high pressure physics research, in geological drilling, to induce chemical reactions, and to initiate reactive materials, for example. Planar shocks as may be provided by the projectile launching device of the present invention may be particularly in useful research and for causing shock-to-detonations. Planar shocks are more persistent than shocks produced by tapered projectiles, and therefore shock more target material to higher pressures. Also, pointy projectiles tend to penetrate and disrupt any reaction induced in shocked target material.

Figure 6:
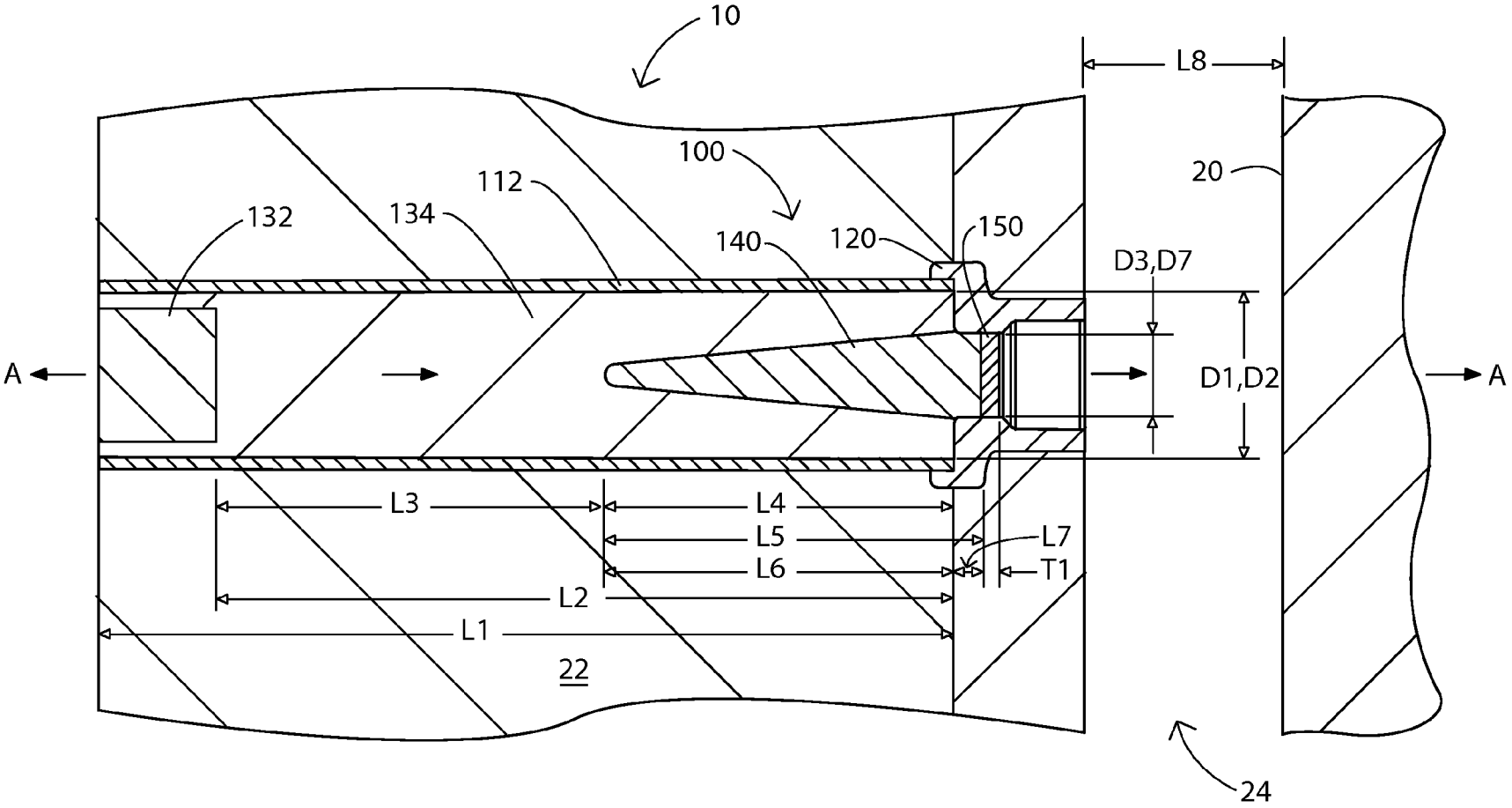
FIG. 6 is a cross-sectional view of a projectile launching system including the launching device of FIG. 1.

With reference to FIGS. 1-7C, a projectile launching device 100 according to embodiments of the present invention is shown therein. The launching device 100 can be incorporated into a projectile launching system 10 as shown in FIG. 6, for example.

Referring to FIGS. 1-5, the launching device 100 includes a housing 110, a shock front generator 130, a buffer member 140 and a projectile or flyer 150. The launching device 100 extends from a rear end 100A to a front end 100B and defines a device axis A-A extending from end 100A to end 100B.

The housing 110 includes a driver containment structure in the form of a tube 112 and a staging structure or member in the form of a bezel 120.

The tube 112 defines a tube axis B-B extending from a tube rear end 112A to a tube front end 112B and coaxial with the axis A-A. The tube 112 defines a cylindrical chamber or passage 116 communicating with a rear end opening 114A and a front end opening 114B.

The tube 112 may be formed of any suitable material or materials. According to some embodiments, the tube 112 is formed of aluminum, steel, or polycarbonate. According to some embodiments, the tube 112 has an ultimate strength of at least about 50 MPa.

According to some embodiments, the passage 116 has a length L1 (FIG. 6) in the range of from about 50 mm to 250 mm, an inner diameter D1 (FIG. 6) in the range of from about 6 mm to 80 mm, and a volume in the range of from about 1.4 cc to 1250 cc.

The bezel 120 defines a bezel bore 121 communicating with each of a rear opening 120A and a front opening 120B and having a bore axis G-G coaxial with the axis A-A. The bezel bore 121 includes, as subsections thereof, a rear bore 122, a main bore 124, and a front bore 126. The main bore 124 has a buffer seat section 124A and a flyer seat section 124B. The main bore 124 is defined by a main bore sidewall 126C. The front bore 126 has a tapered transition section 126A and a muzzle section 126B. A rear flange 129 surrounds the rear bore 122. The rear bore 122 terminates at a rear face 128.

The bezel 120 may be formed of any suitable material or materials. According to some embodiments, the bezel 120 is formed of steel or tungsten alloy. According to some embodiments, the bezel 120 has an ultimate strength of at least about 1 MPa.

The bezel 120 is seated on the front end 112B of the tube 112 such that the front end 112B is seated in the rear bore 122 and abuts the rear face 128. The bezel 120 may be secured to the tube 112 using adhesive, for example. The diameter D5 (FIG. 5) of the main bore 124 is less than each of the diameter D4 of the rear bore 122 and the diameter D6 of the front bore 126. According to some embodiments, the diameter D4 of the rear bore 122 is between about 100 and 200 percent greater than the diameter D5 of the main bore 124. According to some embodiments, the diameter D6 of the front bore 126 is between about 5 and 25 percent greater than the diameter D5 of the main bore 124.

The shock generator 130 includes a booster charge 132 and a reactive driver 134. The booster charge 132 is mounted in the rear end 112A of the tube 112. The reactive driver 134 fills the remainder of the tube 112 to the bezel rear face 128, with the exception of the volume filled by the buffer member 140.

The booster charge 132 may be of any suitable construction to initiate a reaction in the reactive driver 134 as described below. According to some embodiments, the booster charge 132 includes a mass of high explosive having a planar front face 132B and, in some embodiments, a planar rear face 132A. The front face 132B is in direct contact with the reactive driver 134. According to some embodiments, the front face 132B is substantially orthogonal with the axis A-A. According to some embodiments, the booster charge 132 is cylindrical or disc-shaped with a heightwise axis H-H coaxial with the axis A-A. In some embodiments, the booster charge 132 is axisymmetric about the axis H-H. In an exemplary embodiment, the booster charge 132 is a circular disc of high explosive having a thickness in the range of from about 6 mm to 20 mm and a diameter in the range of from about 6 mm to 50 mm. The booster charge 132 can be detonated using a low energy foil 132C on the rear face 132A. Suitable high explosives for the booster charge 132 may include PBXN-5, LX-14, PETN or TATB, for example.

The reactive driver 134 may be of any suitable construction operative to produce a shockwave as described herein. The reactive driver 134 defines a reactive driver axis C-C coaxial with the axis A-A and extending from a rear end 134A to a front end 134B. According to some embodiments, the reactive driver 134 is axisymmetric about the axis C-C. A planar rear end face 136A of the reactive driver 134 directly mates with the front face 132B of the booster charge 132. A planar front end face 136B directly mates with the bezel rear face 128. The reactive driver 134 is generally cylindrical and includes an booster charge section 134A surrounding the booster charge 132, a pre-buffer section 134B extending axially from the booster charge 132 to the buffer member 140, and a buffer section 134C circumferentially surrounding the buffer member 140 from the pre-buffer section 134B to the end face 136B.

The reactive driver 134 may be formed of any suitable high explosive material or materials or other reactive material having a sufficient reaction front velocity (as discussed below). According to some embodiments, the reactive driver 134 is C-4. Other suitable materials may include other solid high explosive (e.g., TNT, PBXN-109, PBXN-110, or PBX-9404), liquid high explosive (such as Astrolite G), smokeless powder (which may contain nitrocellulose, nitroglycerine, or nitroguanidine), or a proper stoichiometric mixture of hydrogen and oxygen, or acetylene and oxygen.

According to some embodiments, the reaction driver 134 has a total length L2 (FIG. 6) in the range of from about 50 mm to 250 mm. According to some embodiments, the reactive driver 134 has an outer diameter D2 in the range of from about 6 mm to 80 mm. According to some embodiments, the length L3 of the pre-buffer section 134B is in the range of from about 0 mm to 125 mm, and the length L4 of the buffer section 134C is in the range of from about 20 to 250 mm.

The buffer member defines a buffer member axis E-E coaxial with the axis A-A and extending from a rear end 140A to a front end 140B. The buffer member 140 is axisymmetric about the axis E-E. According to some embodiments and as illustrated, the buffer member 140 has a rear tapered section 144 that extends from a tip 142 and merges with a bezel section 146, which terminates with a substantially planar front end face 148. The tapered section 144 may be substantially conical or frusto-conical and has an outer surface 144A that is complimentary to and directly engages the surrounding reactive driver 134. In other embodiments, the tapered section 144 may be otherwise shaped such as cylindrical or prismatic. The bezel section 146 has an outer surface 146A that is complimentary to and directly engages the main bore sidewall 124C. The bezel section 146 is disposed in the main bore 124 such that the end face 148 is located in a mid-section of the main bore 124. According to some embodiments, the bezel section 146 is cylindrical. The bezel section 146 may be secured in the main bore 124 with adhesive.

The buffer member 140 may be formed of any suitable material or materials. According to some embodiments, the buffer member 140 is formed of a compressible solid material. In some embodiments, the buffer member 140 is formed of a porous material. According to some embodiments, the buffer member 140 is formed of a solid plastic such as polystyrene, polycarbonate, polymethyl-methacrylate, and/or a porous material such as expanded polystyrene, expanded urethanes, or glass microballoon-filled syntactic foams. Other suitable materials for the buffer member 140 may include expanded porous aluminum, powdered metals in a polymer matrix, or glass microballoon-filled syntactic foams. In some embodiments, the density of the buffer member 140 is in the range of from about 0.2 g/cc to 0.99 g/cc (e.g., for porous, expanded closed and open cell plastics and microballoon-filled syntactic foams) and, in some embodiments, from about 1.0 g/cc to 2.4 g/cc (e.g., for plastics (1.0 to 1.3 g/cc), filled plastics (1.3 to 2.2 g/cc), and porous aluminum (1.8 to 2.4 g/cc)).

According to some embodiments, the buffer member 140 has a total volume in the range of from about 0.32 cc to 320 cc. In some embodiments, the buffer member 140 has a total length L5 (FIG. 6) in the range of from about 23 mm to 290 mm. In some embodiments, the tapered section 144 has a length L6 in the range of from about 20 mm to 250 mm. In some embodiments, the bezel section 146 has a length L7 in the range of from about 3 mm to 40 mm. In some embodiments, the outer diameter D3 of the bezel section 146 (and the maximum diameter of the tapered section 144) is in the range of from about 3.6 mm to 48 mm. In some embodiments, the outer diameter D3 of the bezel section 146 forms a close clearance fit with the main bore sidewall 124C. In some embodiments, the taper angle of the tapered section 144 is in the range of from about 5 to 20 degrees. According to some embodiments, the ratio of the total length L5 to the maximum diameter D3 is in the range of from about 4 to 20.

The flyer 150 is mounted in the main bore 124 and has a flyer axis F-F coaxial with the axis A-A. According to some embodiments, the flyer 150 is axisymmetric about the axis F-F. The flyer 150 is disc-shaped and has a rear face 152, an opposing front face 154, and a circumferential side face 156 extending axially between the end faces 152, 154. According to some embodiments, the faces 152 and 154 are each substantially planar, orthogonal with the axis A-A, and parallel with one another. The front face 154 may be positioned substantially flush with or adjacent the front bore 126. The flyer 150 may be formed of any suitable material or materials. According to some embodiments, the flyer 150 is formed of a metal. According to some embodiments, the flyer is formed of hardened steel, heat treated tungsten heavy alloy, tantalum alloys, or beryllium alloys.

According to some embodiments, the mass of the flyer 150 is at least 0.05 grams and in some embodiments, between about 45 grams and 80 grams. In some embodiments, the outer diameter D7 (FIG. 6) of the flyer 150 is in the range of from about 3 mm to 40 mm, according to some embodiments, the thickness T1 of the flyer 150 in the range of from about 0.1 mm to 8 mm. In some embodiments, the ratio of the outer diameter D7 to the thickness T1 is in the range of from about 5 to 30.

According to some embodiments, the outer diameter D7 of the flyer 150 is greater than the inner diameter D5 of the flyer seat section 124B of the main bore 124 so that a light interference fit is formed therebetween. According to some embodiments, the flyer outer diameter D7 is in the range of from about 0.013 mm to 0.046 mm greater than the flyer seat section inner diameter D5. According to some embodiments, the bore diameter D5 is in the range of from about 99.56 to 99.88 percent of the flyer diameter D7.

According to some embodiments and as shown, the front end face 148 of the buffer member 140 is in direct, flush contact with the rear face 152 of the flyer 150 and is substantially coextensive with the rear face 152. That is, the end face 148 matches the shape and dimensions of the end face 152. In some embodiments and as shown, the faces 148 and 152 are circular, have the same diameter and substantially no portion of the face 148 extends laterally or radially beyond the rear face 152 or vice versa.

With reference to FIG. 6, the system 10 includes a base support 12 in which the tube 112 is seated, and a shield wall 14 in which the bezel 120 is seated. In the illustrated embodiment, a target 16 (i.e., the item that the flyer 150 is intended to impact) is spaced apart from the front end 100B by a stand-off gap 18. According to some embodiments, the distance L8 (FIG. 6) of the gap 18 is in the range of from about 15 mm to 5000 mm. The base support 12 and the shield wall 14 may be formed of any suitable material or materials depending on the intended application. In some embodiments, the base support 12 and shield 14 are formed of steel.

The target 16 and the projectile launching device 100 may be integrated into the same device or structure, may be separable or discrete components from one another, or may be incorporated into separable or discrete components. Examples of assemblies that may include the projectile launching device 100 include experimental apparatus and set ups, munitions, and bore hole and mining equipment.

Figure 7A:
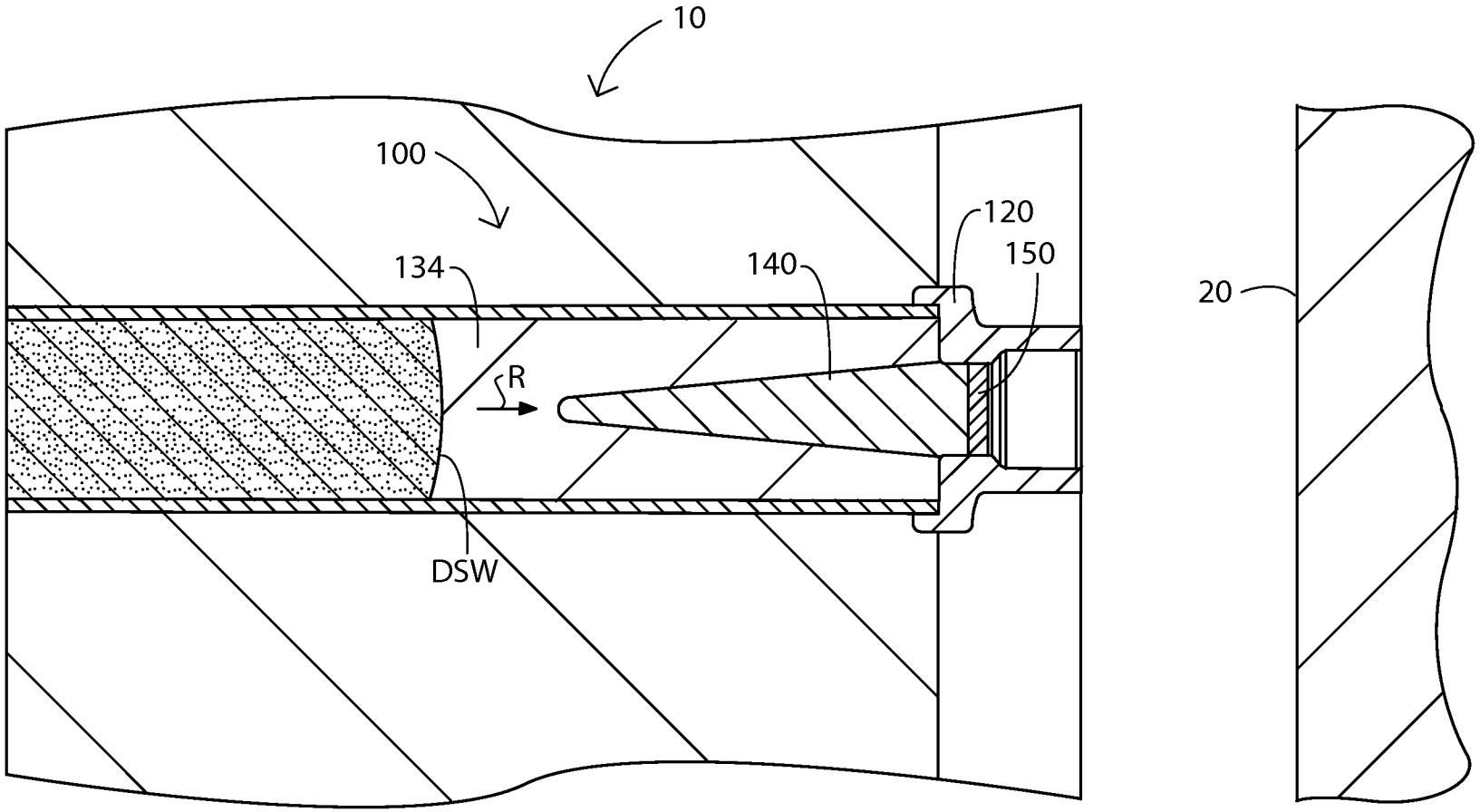
FIGS. 7A-7C are cross-sectional views of the projectile launching system from FIG. 6 illustrating a firing sequence thereof.
Figure 7B:
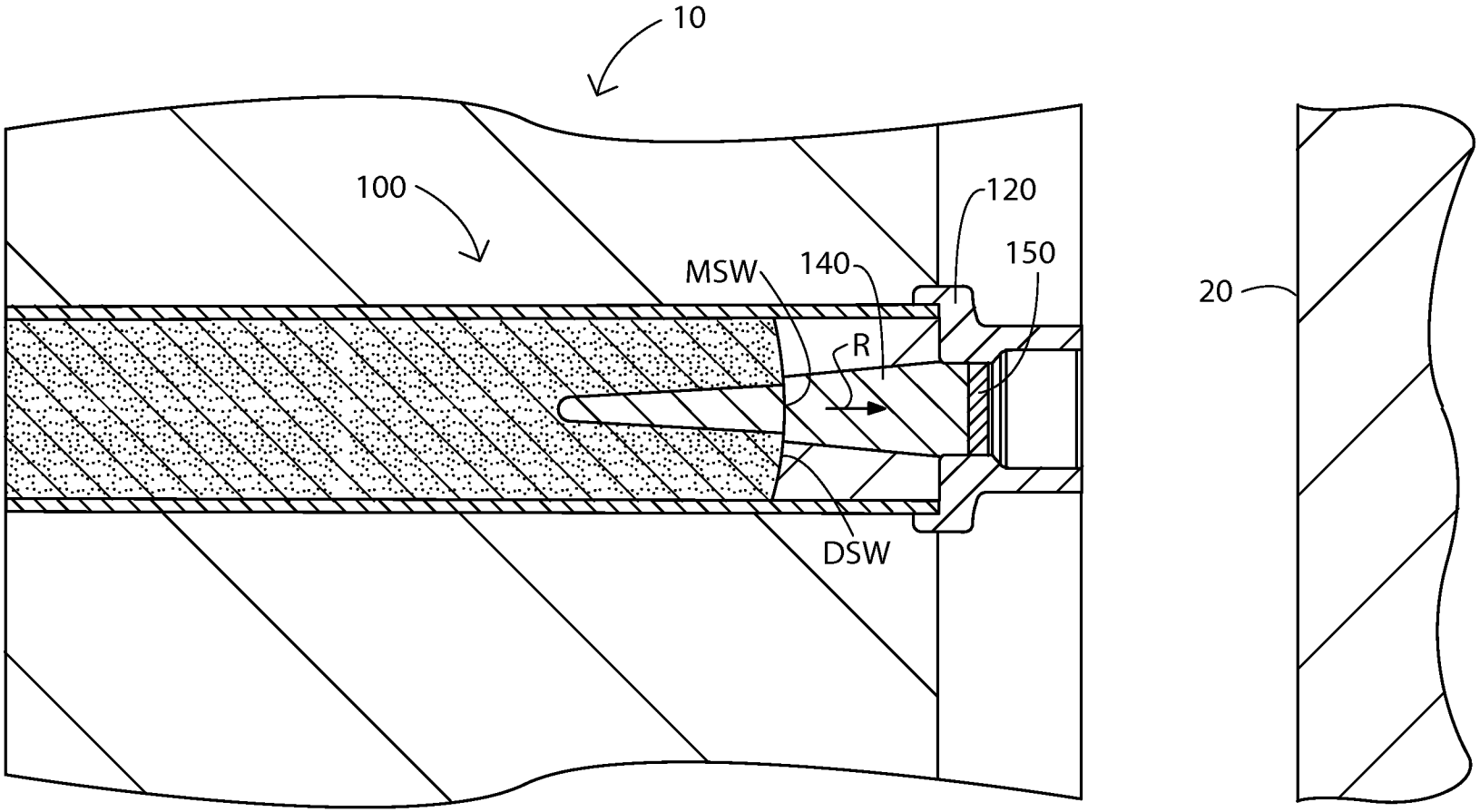
Figure 7C:
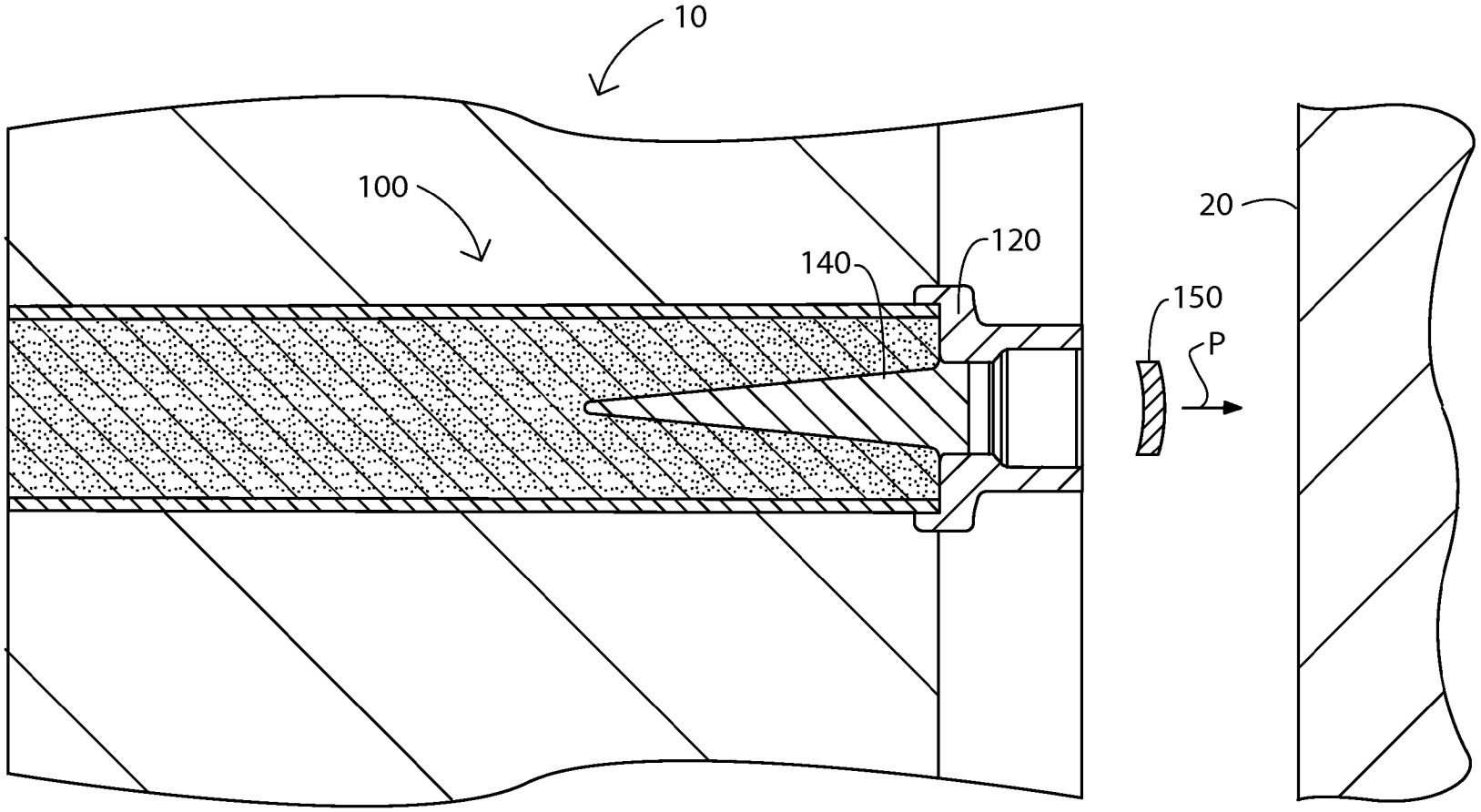

Operations of the launching device 100 will now be described with reference to FIGS. 6-7C. In use, the booster charge 132 is detonated. The detonation of the booster charge 132 in turn detonates the reactive driver 134 at its rear end 134A. The detonation of the reactive driver 134 propagates in a forward direction R generally coaxial with the axis A-A. The energy released from the reactive driver 134 creates a detonation shockwave or front DSW (which may also be referred to as a "reaction front") that likewise travels in the direction R, as illustrated in FIG. 7A. A portion of the detonation shockwave DSW travels into or impinges on the buffer member 140 and is attenuated and modified by the buffer member 140 into a buffered or modified shockwave or front MSW that travels axially through the buffer member 140 in the direction R, as illustrated in FIG. 7B. The modified shockwave MSW is ultimately transmitted by the buffer member 140 to the flyer 150 through the direct contact interface 103 between the end face 148 and the rear face 152. The flyer 150 is thereby rapidly accelerated and propelled or projected at a high velocity or hypervelocity out of the bore 121 in a direction P coaxial with the direction R and the axis A-A as illustrated in FIG. 7C. In some embodiments, the propelled flyer 150 may impact a target 20 at an impact region and thereby create a shockwave (and corresponding pressure) and/or perforation in the target. The target impact region may be located a distance from the launching device 100.

Operations and aspects of the launching device 100 and system 10 will now be described in further detail.

At the outset, the launching device 100 is provided in a state as illustrated in FIG. 6. The launching device 100 may be securely mounted in the base support 22 as shown or otherwise supported such that the bezel opening B is directed at the target 20. A stand off may be provided between the launching device 100 and the target 20 as described above or the target may be in contact with the bezel 120 or the flyer 150.

The booster charge 132 may be triggered or actuated by any suitable method. For example, an exploding bridge wire initiator, or low energy exploding foil initiator may be used. The detonated booster charge 132 starts the high explosive reaction (energy release) of the reactive driver 134 at the booster charge section 134A thereof. The location of the booster charge 132 and the initiated reaction creates a detonation shockwave DSW that moves axially along the launching device 100 in the direction R.

The shape of the booster charge 132 (in particular, the cylindrical or disc-shape and the planar face 132B orthogonal to the axis A-A) can cause or facilitate the formation of a detonation shockwave DSW that is substantially planar and orthogonal to the axis A-A (and the buffer member axis E-E) by the time the detonation shockwave DSW reaches the end 140A of the buffer member 140 or another prescribed axial location in the tube 112. In some embodiments, the pre-buffer section 134B of the reactive driver 134 is configured and of sufficient length (i.e., from the booster charge 132 to the end 140A) that the boundary conditions of the reactive driver geometry cause the detonation shockwave DSW to assume a substantially planar shape orthogonal to the axis A-A by the time the detonation shockwave DSW arrives at the buffer member end 140A. However, in some embodiments, the booster charge 132 is configured to create a detonation shockwave DSW that is immediately generally planar and orthogonal to the axis A-A and little or no reactive driver 134 is interposed axially between the booster charge 132 and the buffer member 140 (i.e., the reactive driver section 134 can be reduced or eliminated all together).

The buffer member 140 and the reactive driver 134 are coaxially arranged. As a result, as the planar detonation shockwave DSW in the reactive driver 134 travels axially through the tube 112 in the direction R, the detonation shockwave DSW axially progressively and axisymmetrically acts on the buffer member 140 starting at the tip 142 and moving toward the end face 148. The detonation shockwave DSW thereby creates a high pressure shockwave or front (i.e., the modified shockwave MSW) in the buffer member 140 traveling (coincident with or slightly ahead of the detonation shockwave DSW) in the direction R toward the flyer 150. Because the detonation shockwave DSW is travelling axially forward across the buffer member 140, the only opportunity for relief (i.e., volumetric expansion of the material of the buffer member 140) is forward toward the flyer 150, thereby ensuring that the modified shockwave MSW is high pressure and traveling in the forward direction R.

The substantially planar modified shockwave MSW continues to travel forwardly in the direction R (and oriented orthogonally thereto) through the explosively compressed buffer member 140 to the interface 103, where the buffer member end face 148 is in direct, planar face to planar face contact with the rear face 152 of the flyer 150. The modified shock wave MSW is transmitted from the buffer member 140 to the flyer 150 at the interface 103 by particle momentum transfer, which in turn causes the flyer 150 to rapidly accelerate and fly forward in the direction P (coaxial with the direction R) out of the bore 121.

More particularly, the modified shockwave MSW has the form of a sharp positive (i.e., compressive) pressure rise. A compressive shockwave is produced in the flyer 150 when the modified shockwave MSW from the buffer member 140 impinges upon the flyer 150, and particle momentum is thereby transferred from the buffer member 140 to the flyer 150. The velocity and the magnitude of the pressure of the shockwave induced in the flyer 150 are functions of the relative shock impedances of the materials of the buffer member 140 and the flyer 150. The compressive shockwave traverses the flyer 150 in the direction R and until the compressive shockwave reaches the opposing flyer free surface (i.e., the front end face 154) where forward motion of the free surface 154 caused by the compressive shockwave effectively converts forward (i.e., in direction R) particle momentum into flyer forward motion. As a result, the flyer 150 is propelled out of the bore 121 in the direction P. A portion of the compressive shockwave reflects off the flyer free surface 154, which may create follow-on shockwave and stress reflections (and thereby negative or tensile pressures in the flyer 150) that reduce the initial forward motion of the flyer 150 to some extent (typically, by a small amount such as less than 10 percent). The size of the reflected shockwave will be a function of the impedance mismatch (if any) between the buffer member material and the flyer material. That is, the more the shock impedance of the flyer 150 exceeds that of the buffer 140, the greater the portion of the shock energy that will be reflected.

In the foregoing manner, the buffer member 140 serves as a buffer between the high pressure from the detonation wave in the reactive driver 134 (i.e., the detonation shockwave DSW) and the flyer 150. The detonation shockwave DSW is highly efficient in transmitting shock and has a very high pressure. Without the buffer member 140 intervening, the very high compressive shock created by the detonation shockwave DSW will reflect from the front surface of the flyer 150 and create high tensile shockwave stresses in the flyer 150, which would tend to induce spalling or breakup of the flyer 150.

The buffer member 140 modifies the detonation shockwave DSW so that the shockwave transmitted to the flyer 150 by the buffer member 140 (i.e., the modified shockwave MSW) is less prone to cause spalling or breakup of the flyer 150. The buffer member 140 has a shock impedance less than that of the detonation shockwave DSW and closer to the shock impedance of the flyer 150 than that of the detonation shockwave DSW. According to some embodiments, the shock impedance of the buffer member 140 is less than the shock impedance of the flyer 150. The buffer member 140 (even when compressed by the detonation shockwave DSW) is less efficient than the detonation wave at transferring particle momentum to the flyer 150. As a result, the buffer member 140 extends the duration of particle momentum transfer to the flyer 150 while also reducing the pressure transmitted to the flyer 150. That is, the buffer member 140 sets an upper limit on the fraction of the detonation shockwave DSW transmitted to the flyer 150. The pressure profile of the modified shockwave MSW in the buffer member 140 is less compact and lower than the pressure profile in the detonation shockwave DSW. The buffer member 140 can thereby act as a shockwave shaper that limits the maximum pressure transmitted to the flyer 150. By limiting the maximum transmitted pressure, the buffer member 140 can ensure that the tensile shockwave peak (and resulting tensile pressure) induced in the flyer 150 is too low to cause the flyer to spall. The particles of the buffer member 140 do not attain momentum sufficient to cause excessive destruction of the flyer 150.

The arrangement of the launching device 100 generates a compact, well organized MACH stem when detonation of the reactive driver 134 is initiated by the booster charge 132 as described to generate a planar detonation shockwave DSW. The MACH stem is a product of the shockwave being constrained by the tube 112 and compressed radially faster than it can be released axially, thereby generating a very high pressure, fast moving (as fast as the detonation speed of the reactive driver 134) shock from the reaction front or detonation shockwave DSW. In order to achieve a planar detonation shockwave DSW at the flyer 150, the reactive driver 134 should be provided with a sufficient run distance to form the MACH stem. However, it is not necessary for the tube 112 to maintain its integrity (e.g., the tube 112 may shatter) as the reactive driver 134 is detonated.

According to some embodiments and as illustrated, the flyer 150 is accelerated or propelled by the particle momentum transfer of the modified shockwave MSW, not gas pressure generated by the explosion of the reactive driver 134. The flyer 150 is launched by the modified shockwave MSW at such a high velocity that the flyer 150 outruns such gas pressure.

According to some embodiments, the disc-shaped flyer 150 is projected out of the launching device 100 with the disc axis of symmetry F-F coaxial with the direction of launch P. According to some embodiments, the flight of the flyer 150 is stable at least from the launching device 100 to the target 20. By "stable", it is meant that the flyer 150 does not tumble, flip or assume an orientation wherein one edge of the front face 154 persistently precedes another. However, the flyer 150 may wobble about the axis F-F to a limited degree. That is, in some embodiments, the launching device 100 is designed such that the target will reliably be struck by the front face 154 of the flyer 150, not the rear face 152. The trajectory of the flyer 150 will typically be ballistic in the presence of gravity, as no appreciable lift is created. According to some embodiments, during flight the flyer 150 will maintain its launch orientation through a distance of at least 10 times its diameter D7, and, in some embodiments, at least 100 times its diameter D7. This enables the launching device 100 to be effectively employed with a stand-off from the target 20. The flyer 150 may be subject to drag forces from any medium(s) it flies through.

The stability of the flyer 150 throughout flight is attributable to good alignment between the compressive shockwave and the front end face 154. Misalignment between the compressive shockwave and the front face 154 could cause the flyer 150 to rotate or break. The launching device 100 can project the flyer 150 stably at high velocity (e.g., supersonic velocity).

According to some embodiments, the launching device 100 functions by design to project the flyer 150 at high velocity or hypervelocity only when the reactive driver 134 is properly initiated (i.e., initiated in a prescribed manner, referred to herein as "primary mode initiation"). For primary mode initiation, the location of initiation must be at the aft end 134A of the reactive driver 134 and centered about the longitudinal axis A-A. This is because the detonation shockwave DSW must be planar or nearly planar when it reaches the buffer member 140 and must travel axially along the buffer member 140 in a planar orientation. If the detonation of the reactive driver 134 is initiated sympathetically at a point or region other than the prescribed or intended initiation location (referred to herein as "non-primary mode initiation") the velocity of the projected flyer 150 will be less than the prescribed high velocity or hypervelocity (e.g., less than 500 meters per second). Non-primary mode initiation may also result in unstable flight of the flyer 150. Non-primary initiation or sympathetic detonation of the reactive driver 134 may be caused by shockwaves that originate elsewhere in a larger assembly that includes the launching device 100. When the launching device 100 is configured as described, the launching device 100 can act passively to selectively control or modulate shockwave generation in the target 20. For example, the launching device 100 may only launch the flyer 150 at full velocity when properly triggered by the booster charge 132, and if otherwise triggered, will launch the flyer 150 at a substantially lower velocity.

The function of the launching device 100 can be to produce a high pressure shockwave (having both high peak pressure and high particle speed) in the target 20, to penetrate the target, or some combination of both. Shockwave strength and penetration depth are generally determined by a combination of flyer material, flyer geometry, flyer impact conditions, and target material. The launching configuration can be tailored to achieve desired target shock strength and duration. The nature of the shockwave is predictable and can be adjusted based on one or more of the following factors: buffer member material (buffer member density and porosity influence flyer velocity, and thus shock strength); flyer material (flyer density affects the initial velocity that can be obtained, flyer shock impedance affects shock strength, flyer thickness is a factor in shock duration and relief wave timing, and flyer diameter determines area of effect); reactive driver material (reactive driver reaction pressures and velocity affect flyer initial velocity, and thus shock strength); and stand-off distance (any drag on the flyer will reduce its velocity, and therefore reduce shock strength; however, shock duration may increase).

While a buffer member having a conical shape is illustrated, other shapes may be employed as discussed above. However, the conical geometry may be useful in maximizing the amount of reactive driver 134 in the launching device 100 for a given overall size of the launching device 100. In some embodiments, the buffer member 140 may extend the full length of the reactive driver 134.

A range of materials may be used for the buffer member 140. According to some embodiments, the shock impedance of the buffer member material is less than the shock impedance of the material of the flyer 150. By using a buffer member material having a lower shock impedance than that of the flyer 150, the risk or tendency of the flyer 150 to be broken up can be reduced or eliminated. It has also been found that more compressible, porous materials for the buffer member 140 will produce higher velocities in a given flyer 150.

As discussed above, any suitable reactive driver 134 may be used. The reactive driver 134 may be a solid, powder, liquid or gas, as long as sufficient reaction front velocity and pressure are produced by the reaction. The flyer velocity is a function of the reaction initiation point, the shape and orientation of the reaction front speed, and the reaction front pressure. A greater reaction front velocity and a high reaction front pressure will produce a faster flyer.

According to some embodiments, the launching device 100 is scalable to launch either smaller or larger flyers at high velocity or hypervelocity as described herein. Scale up will allow for increased flyer size and mass. Scale down may be useful for producing fine scale effects, or incorporation into a small assembly.

The flyer 150 may be made from any suitable material having adequate spall strength. Spall failure is caused by shock transmitted from the buffer member 140 to the flyer 150. As discussed above, the risk or tendency for the flyer 150 to spall can be reduced or eliminated by providing the buffer member 140 with a lower shock impedance than the flyer 150. Using a lower density buffer member material and a lower energy reactive driver may allow for a relatively weak material (such as copper, gold, aluminum, magnesium, or polycarbonate) to be launched without significant spalling. Geological materials (such as diamond, sapphire or granite) maybe launched with a properly configured buffer member 140 and reactive driver 134.

Configuration of the bezel 120 can be instrumental in preventing reflected stress waves that might otherwise cause spall in the flyer 150. According to some embodiments and as illustrated, the diameter D4 of the rear bore 122 of the bezel 120 just below the flyer 150 is substantially greater than the diameter D5 of the flyer seat section 124B to allow dispersion of shock and stress waves. In some embodiments, the diameter D4 is at least 2.5 times the diameter D5 and, in some embodiments at least 5 times greater. According to some embodiments, the diameter D6 of the muzzle bore section 126B is greater than the diameter D7 of the flyer 150 to allow clearance for radial expansion of the flyer 150 when launched. According to some embodiments, the muzzle bore diameter D6 is at least 105 percent of the flyer diameter D7.

According to some embodiments, the target shock pressure (i.e., the impact pressure of the flyer 150 on the target 20) when the launching device 100 is fired with primary mode initiation is at least 8 GPa and, in some embodiments, is at least 20 GPa. According to some embodiments, the velocity of the flyer 150 is at least 2.0 km/s. According to some embodiments, the flyer 150 is accelerated at a rate of at least 2.0 mm/$\mu s^2$ and, in some embodiments, at least 3.0 mm/$\mu s^2$.

According to some embodiments, the velocity of the detonation shockwave DSW is at least 7 km/s. According to some embodiments, the detonation shockwave DSW has a shock pressure of at least 28 GPa and, in some embodiments, in the range of from about 15 GPa to 36 GPa.

According to some embodiments, the velocity of the modified shockwave MSW is in the range of from about 5 km/s to 8 km/s. According to some embodiments, the modified shockwave MSW has a shock pressure of at least 5 GPa and, in some embodiments in the range of from about 10 GPa to 40 GPa.

Figure 8:
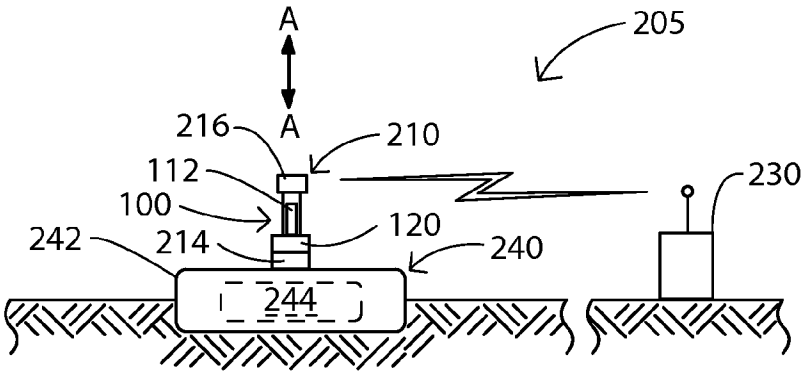
FIG. 8 is a side view of a system including the launching device of FIG. 1 for detonating a detonable device.

According to some embodiments, a projectile launching device as described herein (e.g., the device 100) is used to selectively detonate an unexploded detonable device. An exemplary arrangement or system 205 is illustrated in FIG. 8. This system 205 includes a triggering device or unit 210, a controller 230, and an unexploded detonable device 240.

The detonable device 240 may be any suitable detonable device that can be triggered to explode by application of a suitable impact or shock thereto. The detonable device 240 may be an unexploded ordinance or munition (e.g., Mk 82 general purpose bomb, or improvised explosive device composed of high explosive filled artillery shells), for example. The illustrated detonable device 240 has an outer casing 242 containing an explosive 244 (e.g., a high explosive). The device 240 is constructed such that application of sufficient shock to the casing 242 will trigger the high explosive 244 to detonate.

The triggering unit 210 includes the projectile launching device 100, a mounting device or base 214, and an actuator 216.

In use, the bezel 120 of the launching device 100 is secured to or held in place on the casing 242 by the base 214 such that the axis A-A intersects the casing 242 and, according to some embodiments, is substantially orthogonal to a substantially planar surface of the casing 242. The base 214 may provide a stand off between the casing 242 and the bezel 120.

The actuator 216 may be any suitable device operable to detonate the booster charge 132 when desired. The actuator 216 may include a timer or a wireless transceiver configured to wirelessly communicate with the remote controller 230. The controller 230 may be operable by a user to selectively activate the actuator 216 to detonate the booster charge 132.

According to some embodiments, the triggering unit 210 can be mounted on the casing 242 using the base 214. The actuator 216 can then be activated (e.g., by a command from the remote controller 230) to detonate the booster charge 132. Detonation of the booster charge 132 in turn initiates detonation of the reactive driver 134, which in turn propels the flyer 150 as described above. The launched flyer 150 strikes or impacts the casing 242, thereby imparting a corresponding impact shock to the casing 242. The impact shock triggers the unexploded device 240 to explode.

As discussed above, the launching device 100 can be configured such that it will not only launch the flyer 150 at the prescribed high velocity or hypervelocity if the reactive driver 134 is detonated using the primary mode initiator. The launching device 100 can be integrated into an explosive device to provide selectable yield using this aspect of the launching device 100. The alternative, selectable yields may differ in magnitude of explosive force, type of effect and/or geometry of effect, for example.

Figure 9:
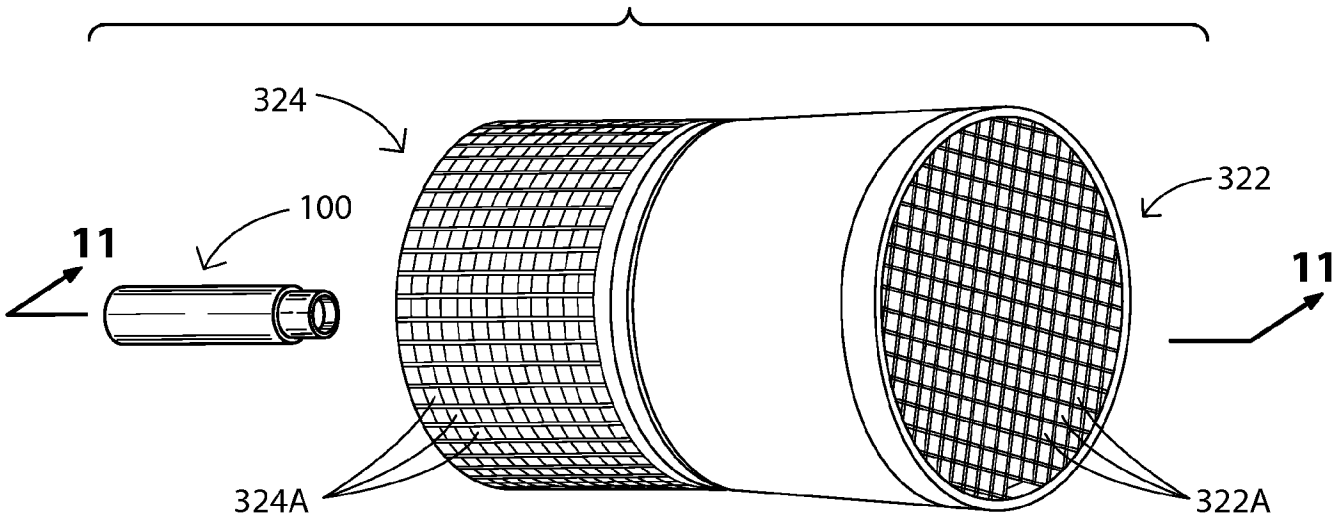
FIG. 9 is a partially exploded, front perspective view of a variable, selectable yield explosive system according to embodiments of the present invention.
Figure 10:
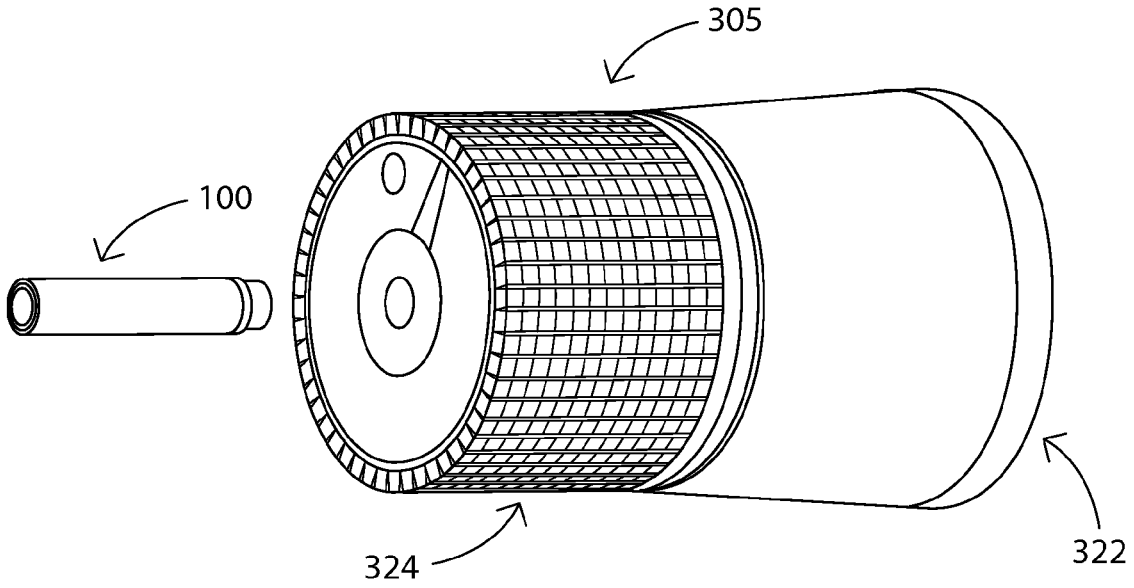
FIG. 10 is a partially exploded, rear perspective view of the explosive system of FIG. 9.
Figure 11:
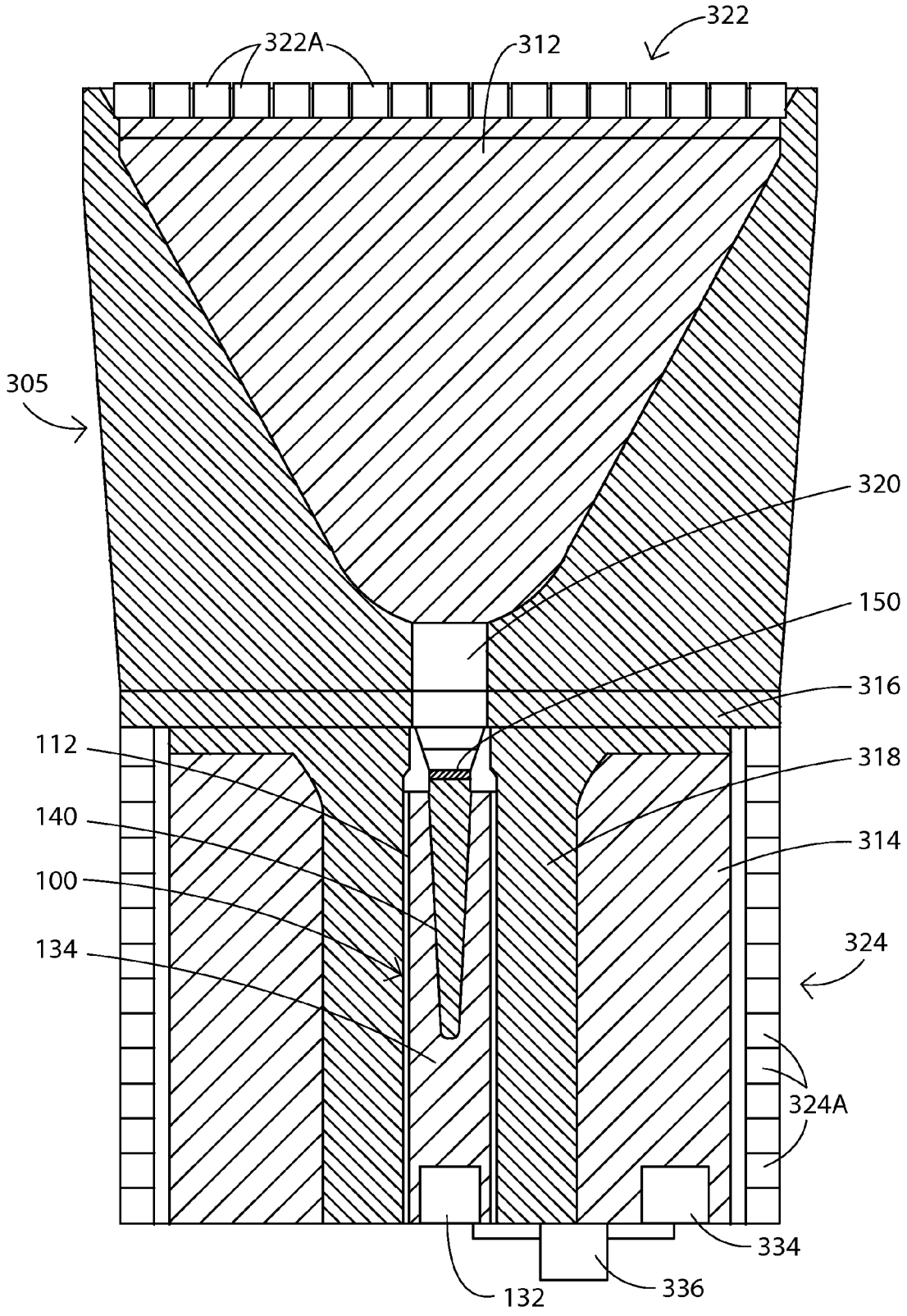
FIG. 11 is a cross-sectional view of the explosive system of FIG. 9 taken along the line 11-11 of FIG. 10.

With reference to FIGS. 9-11, a variable, selectable yield explosive device or system 305 according to embodiments of the invention is shown therein. The system 305 includes the launching device 100, a first or target explosive 312 (e.g., high explosive), a second explosive 314 (e.g., high explosive), a barrier 316 between the explosives 312 and 314, and a barrier 318 between the explosive 314 and the launching device 100. The system 305 further includes a first array 322 of projectiles 322A on the forward end of the system 305 and overlying the first explosive 312, and a second array 324 of projectiles 324A surrounding the rear end of the system 305 and the second explosive 314. The booster charge 132 serves as a first fuse or initiator and the system 305 also includes a second fuse or booster charge 334 and an electronic initiator controller 336 operatively connected to the booster charges 132, 334.

In use, the system 305 can be activated to project two different damage effects: a forward directional projection of the projectiles 322A, and a 360 degree radial projection of the projectiles 324A. The system 305 can be activated in three modes. In the first mode, only the first explosive 312 is detonated, causing the projectile array 322 to be propelled forwardly as a group in a focused longitudinal pattern. In the second mode, only the second explosive 314 is detonated, causing the projectile array 324 to be propelled radially outwardly in a pattern having a 360 degree radial sweep. In the third mode, both explosives 312, 314 are detonated, causing both arrays 322, 324 to be propelled as described. Depending on the selected mode, the controller 336 either: a) triggers or activates the booster charge 132 to (indirectly) detonate the first explosive 312 (first mode selected); b) triggers or activates the booster charge 334 to detonate the second explosive 314 (second mode selected); or c) activates both booster charges 132, 334 to detonate both explosives 312, 314 (third mode selected).

When the first booster charge 132 is triggered, the first explosive 312 is detonated by an impact shock from the flyer 150 (i.e. shock-to-detonation (STD)). More particularly, detonation of the booster charge 132 will cause the launching device 100 to propel the flyer 150 at high velocity or hypervelocity at the first explosive 312 through a passage 320 in the barrier 316. The flyer 150 will impact the explosive 312 and thereby impart a shock to the explosive 312 that causes the explosive 312 to detonate. The barriers 316, 318 segregate the explosives 312 and 314 so that the second explosive 314 is not detonated by the explosion of the first explosive 312.

On the other hand, upon activation the booster charge 334 directly detonates the second explosive 314. The first explosive 312 is sufficiently shielded from the explosion of the second explosive 314 that the first explosive 312 is not detonated thereby. According to some embodiments, the reactive driver 134 is sufficiently shielded from the explosion of the second explosive 314 that the reactive driver 134 will not ordinarily be detonated thereby. According to other embodiments, the system 305 is configured such that the reactive driver 134 will ordinarily be detonated by the explosion of the second explosive 314. In either case, sympathetic detonation of the reactive driver 134 will not cause the launching device 100 to detonate the first explosive 312 as described above. Rather, the detonation of the reactive driver 134 will occur at a location other than the prescribed initiation location for primary mode initiation and the flyer 150 will consequently be launched at a velocity insufficient to detonate the first explosive via STD.

According to some embodiments, the detonation of the detonation of the first explosive 312 (in first mode operation) will cause at least partial destruction of the second explosive 314 and/or the detonation of the second explosive 314 (in second mode operation) will cause at least partial destruction of the first explosive 312. More particularly, in some embodiments, when the system 305 is detonated in the first mode (i.e., the booster charge 132 alone is activated), the reactive driver 134 will operate as a bursting charge to shatter the second explosive 314 without causing the second explosive 314 to detonate. In some embodiments, when the system 305 is detonated in the second mode (i.e., the booster charge 334 alone is detonated) and the reactive driver 134 is sympathetically detonated, the explosive products of the reactive driver 134 will fire into the first explosive 312 through the passage 320 and burn and/or shatter the first explosive 312.

Advantageously, in some embodiments when the system 305 is operated in the third mode, the detonation wave of the launching device 100 will propagate quickly enough that the flyer 150 is properly launched without being impacted or disturbed by the explosion of the second explosive 314. As a result, the system 305 can be substantially or highly insensitive to timing jitter in activation of the booster charges 132, 334.

EXAMPLES

A projectile launching device (hereinafter, the Tested Launcher) in accordance with embodiments of the invention was constructed and tested, and is illustrated in FIGS. 1-5 and 12A-12C.

Figure 12A:
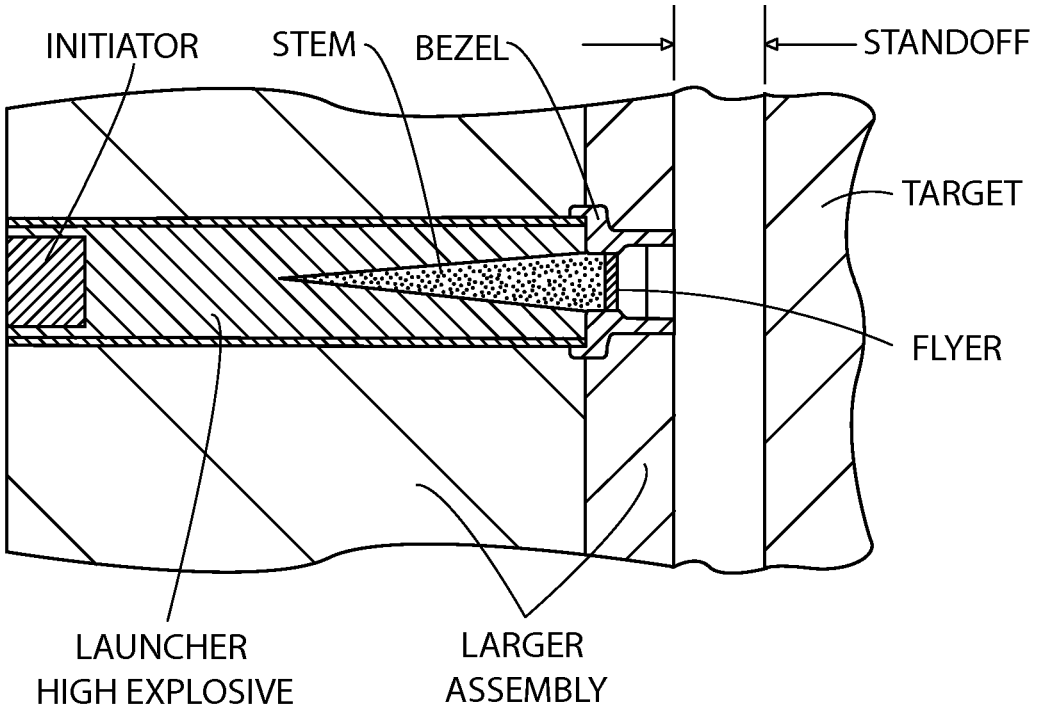
FIGS. 12A-12C illustrate an exemplary projectile launching device according to embodiments of the invention as tested.
Figure 12B:
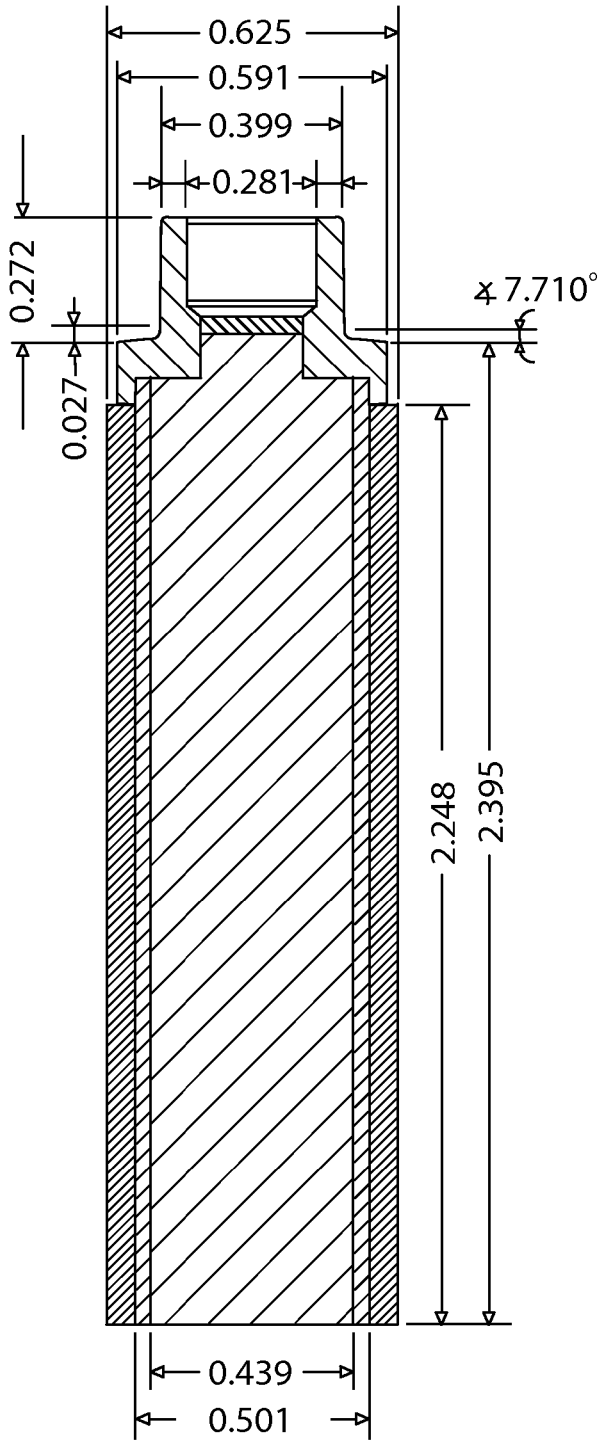
Figure 12C:
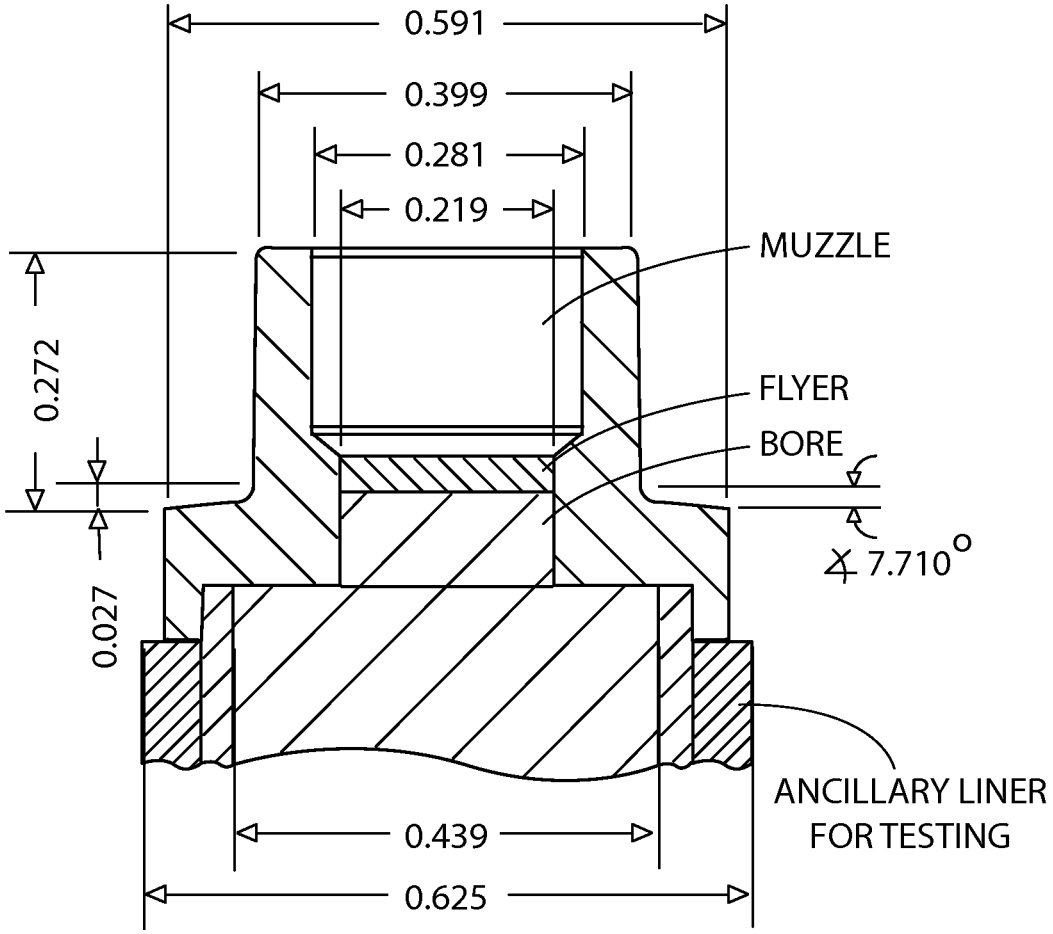

The Tested Launcher had overall dimensions of approximately 1.5 cm in diameter and 7 cm in length. FIGS. 1-5 illustrate the Test Launcher and FIGS. 12A-12C illustrate the Test Launcher as incorporated into the overall test assembly. The tube section was approximately 6 cm in length with an O.D of 1.3 cm and an I.D. of 1.1 cm. The flyer was roughly 0.55 cm in diameter and 0.13 cm thick. The buffer member (which may also be referred to as the stem) was a 10 degree cone with a short cylindrical base. The conical section extended approximately 2.4 cm into the reactive driver, and the cylindrical base extended approximately 0.2 cm into the bore of the bezel. At its conical base the buffer member had the same diameter as flyer. The initiator was 0.5 cm thick, with an O.D. equal to the tube I.D. FIGS. 12B and 12C show dimensions (in inches) for the assembled tube and bezel, and also illustrates a tube liner that was ancillary to some aspects of the testing.

The composition of the Tested Launcher components was as follows:

Tube—6061-T6 aluminum;

Bezel—304 stainless steel;

Flyer—Ti6Al4V (Grade 5) titanium alloy;

Buffer member—polystyrene, ~1.02 gram/cm^3, no expansion;

Reactive Driver—Composition 4 high explosive (C-4); and

Initiator—PBXN-5 high explosive.

Assembly of the Tested Launcher was done with the following steps:

1. The flyer was installed into the bezel bore with a light press fit. This was by design, with a 0.0002" to 0.0005" interference between the flyer diameter and bezel bore. The flyer impact surface was positioned flush with the muzzle side of the bore opening.
2. The cylindrical base of the buffer member was inserted into the tube side of the bore until it contacts flyer. This was a clearance fit, and the buffer member is held in place with adhesive.
3. The tube was partially filled with C-4. The fill extended from what would be the bezel end of the tube, to approximately 1 cm short of the initiator end.
4. The buffer member was inserted in to the C-4 until the bezel coupled with the tube. The bezel was attached to the tube with adhesive.
5. C-4 was packed into the initiator end of the tube until 0.5 cm of tube was left unfilled.
6. An initiator was placed into the tube. It was pressed in to create good contact between it and the C-4. Adhesive tape was used to retain the initiator in the tube.

In the case of the Tested Launcher, high fidelity computer models calculated an initial velocity of approximately 2.65 km/s, and this was reduced to a 2.5 km/s after shockwave relief. High fidelity calculations indicated that the shock front pressure in the buffer member material was in excess of 25 GPa. The front was calculated to be moving forward with a speed equal to the detonation velocity of the C-4, which is approximately 8.2 km/s.

In the Tested Launcher, the initiator was a 0.5 cm thick 1 cm diameter disk of PBXN-5. One side of the disk was placed in direct contact with the C-4 reactive driver. Detonation of the PBXN-5 was done with a low energy exploding foil initiator that acted on the side of the disk opposite the C-4.

Target shock pressures produced by the Tested Launcher were in excess of 20 GPa, Target response in testing indicated that a minimum of 20 GPa was produced upon flyer impact. Standoff for these tests was 2 cm. Penetration of Celotex-like fiberboard target material was measured in tests designed to measure the flyer velocity. The 0.13 g fliers consistently penetrated 20 cm of fiberboard. Standoff for these test ranged from 25 cm to 50 cm. These flyers were recovered intact. Witness paper on the impact surface of the fiberboard repeatedly showed clean, round perforations 0.6 cm in diameter. The nature of the perforations indicated flyer flight is stable.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed:

1. A projectile launching device comprising:

a reactive driver containment structure;

a reactive driver contained in the reactive driver containment structure and that, when detonated, will generate a detonation shock wave;

a flyer housing defining a bore;

a disc-shaped flyer disposed in the bore, the flyer having a rear surface; and a buffer member interposed between the reactive driver and the flyer, the buffer member having a front surface in direct contact with the rear surface of the flyer;

wherein the buffer member is configured and arranged to:

receive the detonation shock wave from the reactive driver;

modify the detonation shock wave to generate a modified shock wave; and transmit the modified shock wave directly to the flyer to thereby propel the flyer away from the buffer member.

2. The projectile launching device of claim 1 wherein the shock impedance of the buffer member is less than the shock impedance of the flyer.

3. The projectile launching device of claim 1 wherein a section of the bore immediately surrounding the flyer has an inner diameter that forms an interference fit with an outer diameter of the flyer.

4. The projectile launching device of claim 1 wherein the buffer member extends into the bore of the flyer housing.

5. The projectile launching device of claim 4 wherein the buffer member extends into the reactive driver.

6. The projectile launching device of claim 1 wherein:

the flyer has a mass of at least about 0.05 grams; and the projectile launching device is configured to propel the flyer at a velocity of at least about 2.0 kilometers/second.

7. The projectile launching device of claim 1 wherein:
the reactive driver containment structure circumferentially surrounds and is radially spaced apart from the buffer member; and
the reactive driver circumferentially surrounds the buffer member and fills a space between the reactive driver containment structure along the length of the buffer member.

8. The projectile launching device of claim 7 wherein:
the reactive driver containment structure extends fully from at least a location rearward of a rear end of the buffer member to the flyer housing; and
the reactive driver extends fully from at least a location rearward of the rear end of the buffer member to the flyer housing.

9. The projectile launching device of claim 1 wherein:
the flyer bore includes:
a main bore on a rear end of the flyer bore; and
a front bore on a front end of the flyer bore;
the flyer is disposed in the main bore; and
the inner diameter of the front bore is greater than the inner diameter of the main bore and the outer diameter of the flyer.

10. The projectile launching device of claim 9 wherein:
the main bore includes:
a buffer seat section; and
a flyer seat section;
the flyer is disposed in the flyer seat section; and
a front portion of the buffer member is disposed in the buffer seat section.

11. The projectile launching device of claim 9 wherein the front bore includes:
a muzzle section on a front end of the front bore; and
a tapered transition section interposed between the main bore and the muzzle section.

12. The projectile launching device of claim 1 wherein:
the shock impedance of the buffer member is less than the shock impedance of the flyer;
the front surface of the buffer member is substantially coextensive with the rear surface of the flyer;
a rear section of the buffer member is axially tapered and circumferentially surrounded by the reactive driver;
a total length of the buffer member is less than a maximum diameter of the buffer member;
the reactive driver containment structure circumferentially surrounds and is radially spaced apart from the buffer member;
the reactive driver circumferentially surrounds the buffer member and fills a space between the reactive driver containment structure along the length of the buffer member;
the reactive driver containment structure extends fully from at least a location rearward of a rear end of the buffer member to the flyer housing;
the reactive driver extends fully from at least a location rearward of the rear end of the buffer member to the flyer housing;
the flyer bore includes:
a main bore on a rear end of the flyer bore, the main bore including a buffer seat section and a flyer seat section; and
a front bore on a front end of the flyer bore;
the inner diameter of the front bore is greater than the inner diameter of the main bore and the outer diameter of the flyer;
the flyer is disposed in the flyer seat section; and
a front portion of the buffer member is disposed in the buffer seat section.

13. A projectile launching device comprising:
a reactive driver containment structure;
a reactive driver contained in the reactive driver containment structure and that, when detonated, will generate a detonation shock wave;
a flyer housing defining a bore;
a flyer disposed in the bore, the flyer having a rear surface; and
a buffer member interposed between the reactive driver and the flyer, the buffer member having a front surface in direct contact with the rear surface of the flyer;
wherein the buffer member is configured and arranged to:
receive the detonation shock wave from the reactive driver;
modify the detonation shock wave to generate a modified shock wave; and
transmit the modified shock wave directly to the flyer to thereby propel the flyer away from the buffer member; and
wherein the front surface of the buffer member is substantially coextensive with the rear surface of the flyer.

14. A projectile launching device comprising:
a reactive driver containment structure;
a reactive driver contained in the reactive driver containment structure and that, when detonated, will generate a detonation shock wave;
a flyer housing defining a bore;
a flyer disposed in the bore, the flyer having a rear surface; and
a buffer member interposed between the reactive driver and the flyer, the buffer member having a front surface in direct contact with the rear surface of the flyer, wherein a rear section of the buffer member is axially tapered and circumferentially surrounded by the reactive driver;
wherein the buffer member is configured and arranged to:
receive the detonation shock wave from the reactive driver;
modify the detonation shock wave to generate a modified shock wave; and
transmit the modified shock wave to the flyer to thereby propel the flyer away from the buffer member; and
wherein a total length of the buffer member is less than a maximum diameter of the buffer member.

15. The projectile launching device of claim 14 wherein the ratio of the total length of the buffer member to the maximum diameter of the buffer member is in the range of from about 4 to 20.

16. A projectile launching device comprising:
a reactive driver containment structure;
a reactive driver contained in the reactive driver containment structure and that, when detonated, will generate a detonation shock wave;
a flyer housing defining a bore;
a flyer disposed in the bore, the flyer having a rear surface; and
a buffer member interposed between the reactive driver and the flyer, the buffer member having a front surface in direct contact with the rear surface of the flyer;
wherein the buffer member is configured and arranged to:
receive the detonation shock wave from the reactive driver;
modify the detonation shock wave to generate a modified shock wave; and transmit the modified shock wave directly to the flyer to thereby propel the flyer away from the buffer member; and wherein:

the flyer bore includes:

a main bore on a rear end of the flyer bore; and a front bore on a front end of the flyer bore;

the flyer is disposed in the main bore; and the inner diameter of the front bore is greater than the inner diameter of the main bore and the outer diameter of the flyer.

17. The projectile launching device of claim 16 wherein:

the main bore includes:

a buffer seat section; and a flyer seat section;

the flyer is disposed in the flyer seat section; and a front portion of the buffer member is disposed in the buffer seat section.

18. The projectile launching device of claim 16 wherein the front bore includes:

a muzzle section on a front end of the front bore; and a tapered transition section interposed between the main bore and the muzzle section.

* * * * *